United States Patent [19]

Berstler

[11] 3,940,649

[45] Feb. 24, 1976

[54] SPARK PLUG CONSTRUCTION

[76] Inventor: Francis E. Berstler, R.D. No. 2, Etters, Pa. 17319

[22] Filed: July 9, 1974

[21] Appl. No.: 486,854

[52] U.S. Cl. ..... 313/122; 123/169 EL; 313/125; 313/133; 313/138; 313/141; 313/143; 313/145

[51] Int. Cl.[2] ..... H01T 13/28; H01T 13/56; H01T 13/08

[58] Field of Search ..... 313/118, 122, 125, 127, 313/133, 138, 141, 143, 144, 145, 141.1; 123/169 R, 169 CL, 169 CM, 169 EL, 169 E

[56] References Cited

UNITED STATES PATENTS

| | | | |
|---|---|---|---|
| 1,098,637 | 6/1914 | Rauch | 313/141.1 X |
| 1,442,423 | 1/1923 | Casper | 313/145 X |
| 2,685,872 | 10/1954 | Berstler | 313/125 |
| 3,300,672 | 1/1967 | Fisher | 123/169 CL X |
| 3,581,141 | 5/1971 | Beaubier | 313/143 X |

*Primary Examiner*—Alfred L. Brody
*Attorney, Agent, or Firm*—Clarence A. O'Brien; Harvey B. Jacobson

[57] ABSTRACT

The spark plug has been designed so as to, be capable of being disassembled for cleaning, have a substantially full shield for the spark gap end of the center electrode portion, enable the center electrode to be readily replaced, if desired, enable partial cleaning of the spark plug gap area without removal of the spark plug from an associated engine, and have a substantially full gas seal defined between the base of the spark plug and the spark plug insulative sleeve.

Figure 1:
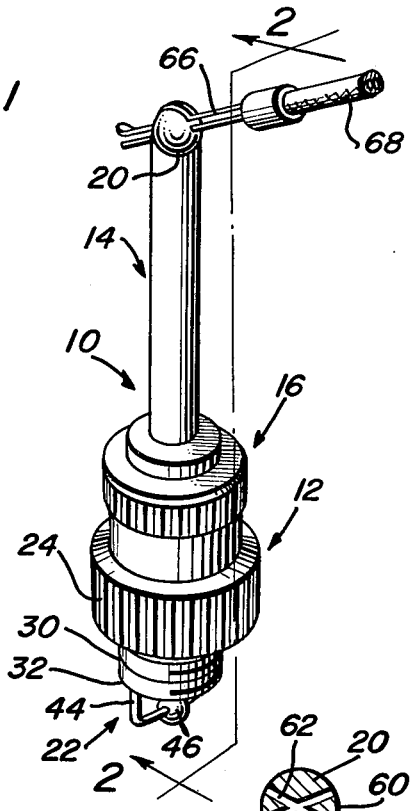
Figure 2:
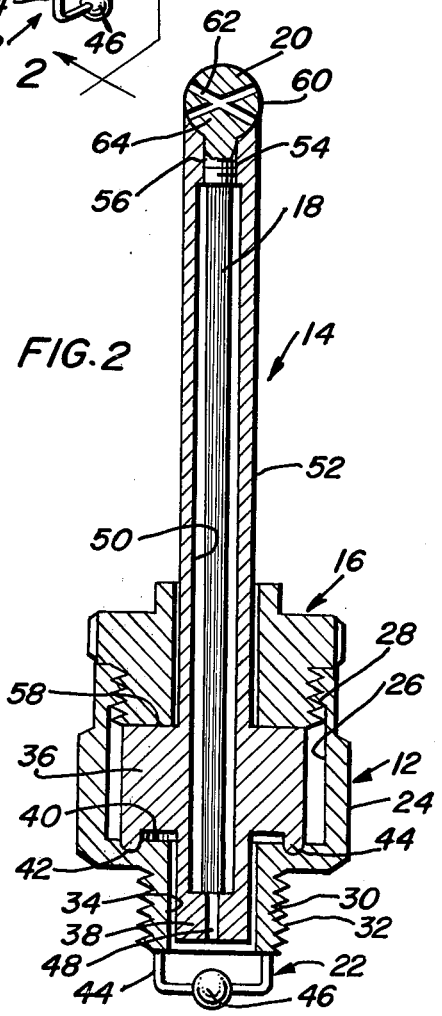
Figure 3:
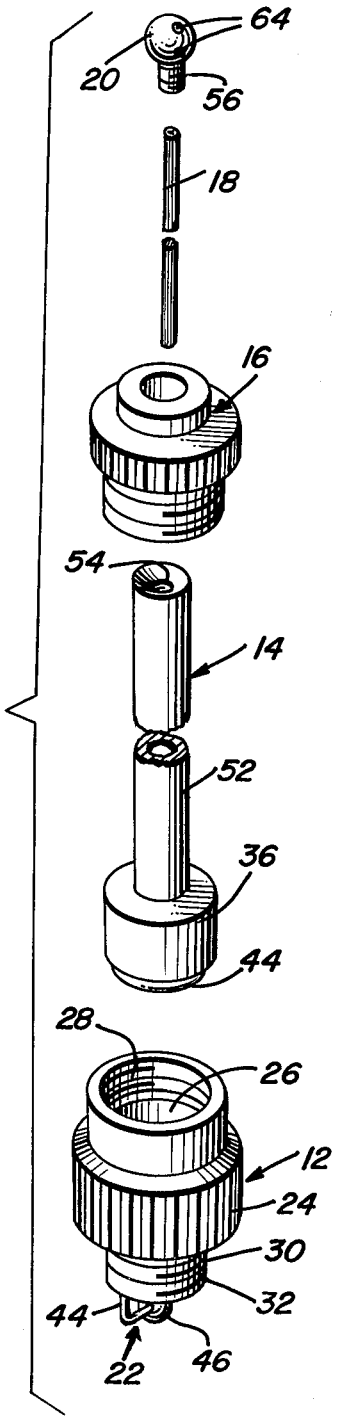

4 Claims, 3 Drawing Figures